United States Patent [19]

Van Oord

[11] Patent Number: 5,012,628

[45] Date of Patent: May 7, 1991

[54] METHOD AND APPARATUS FOR ARRANGING ARTICLES

[75] Inventor: Jan J. J. Van Oord, Ulvenhout, Netherlands

[73] Assignee: Breda Packaging B.V., Breda, Netherlands

[21] Appl. No.: 396,243

[22] Filed: Aug. 21, 1989

[30] Foreign Application Priority Data

Aug. 22, 1988 [NL] Netherlands ..... 8802075

[51] Int. Cl.[5] ..... B65B 5/10; B65B 35/40

[52] U.S. Cl. ..... 53/448; 53/245; 53/251; 53/475; 53/534; 53/535; 53/543

[58] Field of Search ..... 53/245, 251, 534, 535, 53/542, 252, 448, 475, 537, 543, 443, 473, 536; 206/45.31, 499; 299/164

[56] References Cited

U.S. PATENT DOCUMENTS

| | | | |
|---|---|---|---|
| 3,280,968 | 10/1966 | Craine | 206/499 X |
| 3,343,659 | 9/1967 | Marondel | 206/45.31 |
| 3,599,397 | 8/1971 | Standley . | |
| 4,149,355 | 4/1979 | Clegg | 53/534 X |
| 4,433,526 | 2/1984 | Nord | 53/534 X |
| 4,524,566 | 6/1985 | Hauers et al. | 53/534 |
| 4,608,808 | 9/1986 | Ryan . | |
| 4,633,651 | 1/1987 | Edmunds | 53/534 X |
| 4,633,653 | 1/1987 | Roberts et al. | 53/535 X |
| 4,750,315 | 6/1988 | Wadell | 53/534 X |

FOREIGN PATENT DOCUMENTS

| | | |
|---|---|---|
| 0153577 | 3/1987 | European Pat. Off. . |
| 169444 | 6/1965 | U.S.S.R. . |

*Primary Examiner*—Robert L. Spruill
*Assistant Examiner*—Linda B. Johnson
*Attorney, Agent, or Firm*—Fidelman & Wolffe

[57] ABSTRACT

A method and an apparatus for arranging articles in a container, wherein the articles are stacked within the container. In one embodiment, a container is fed in a substantially horizontal upper position and transferred to a nonhorizontal position. Articles are horizontally fed to the container while the container is in the nonhorizontal position, and the articles are stacked in rows within the container. The articles are arranged such that the container can be used to display the articles for sale.

17 Claims, 3 Drawing Sheets

METHOD AND APPARATUS FOR ARRANGING ARTICLES

Figure 1:
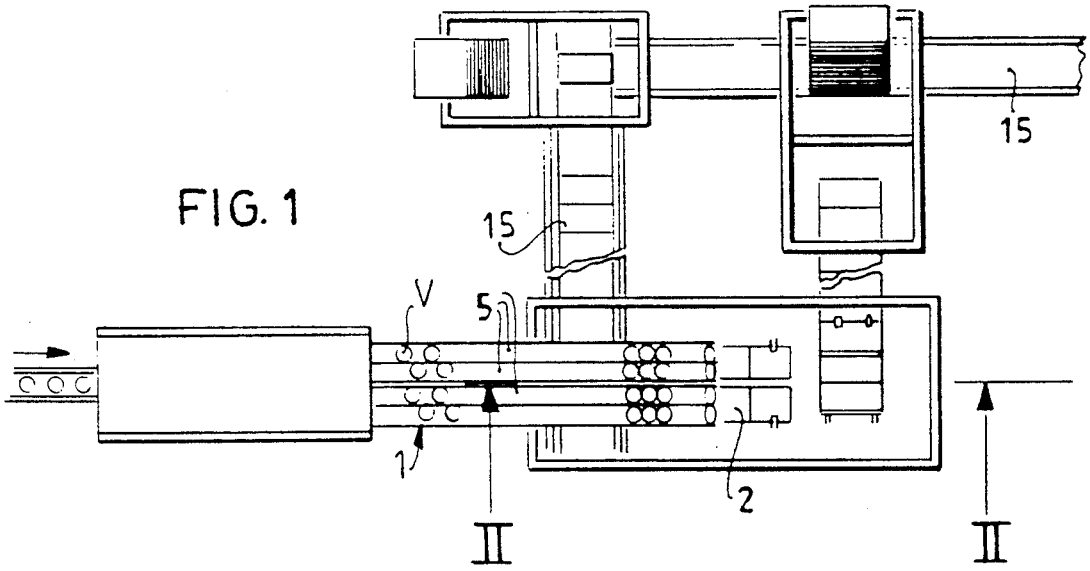

The invention relates to a method for arranging articles, such as packagings for a product, whereby the articles are supplied one by one or group-wise in a feed direction.

In the stacking or the packaging of articles it often occurs that the articles have to be placed in a particular arrangement allowing any easy introduction into a holder, for instance a box, which box later serves as a "display" at the retail point, a supermarket for example, whereby the arrangement is such that the product is optimally visible to the customer. The customer then takes the article directly from this holder or box. Up until the present it has been usual to first stack the articles separately and to arrange the stacks one by one or group-wise in the holder.

The invention has for its object to improve this method so that the packaging of products that are difficult to pack, for instance round boxes and the like, can take place simply and flexibly, and in particular continuously.

The method according to the invention is distinguished in that a support for stacking, such as holder to be filled, is carried in a direction of movement which encloses an angle with the feed direction of the articles.

As a result of this angular setting of the two directions of movement, it is possible to adapt the position of the support to the shape and type of packaging of the articles, and wherein the articles can be directly stacked onto each other in the holder. The force of gravity can be used to order the articles in rows and/or columns in the holder, such that these articles lie in a position allowing them to be sold directly from the holder.

According to one embodiment the direction of movement of the support or holder is vertical, which simplifies the stacking particularly of articles of Fustum conical shape.

The invention further relates to an apparatus for performing the above stated method. The apparatus according to the invention is characterized by a first conveyor for supplying the articles at an interval from each other, and a second conveyor for moving the support or holder, whereby the angle of the discharge device at the run-off end of the first conveyor is perpendicular to the direction of forward movement of the second conveyor for the holder.

Figure 2A:
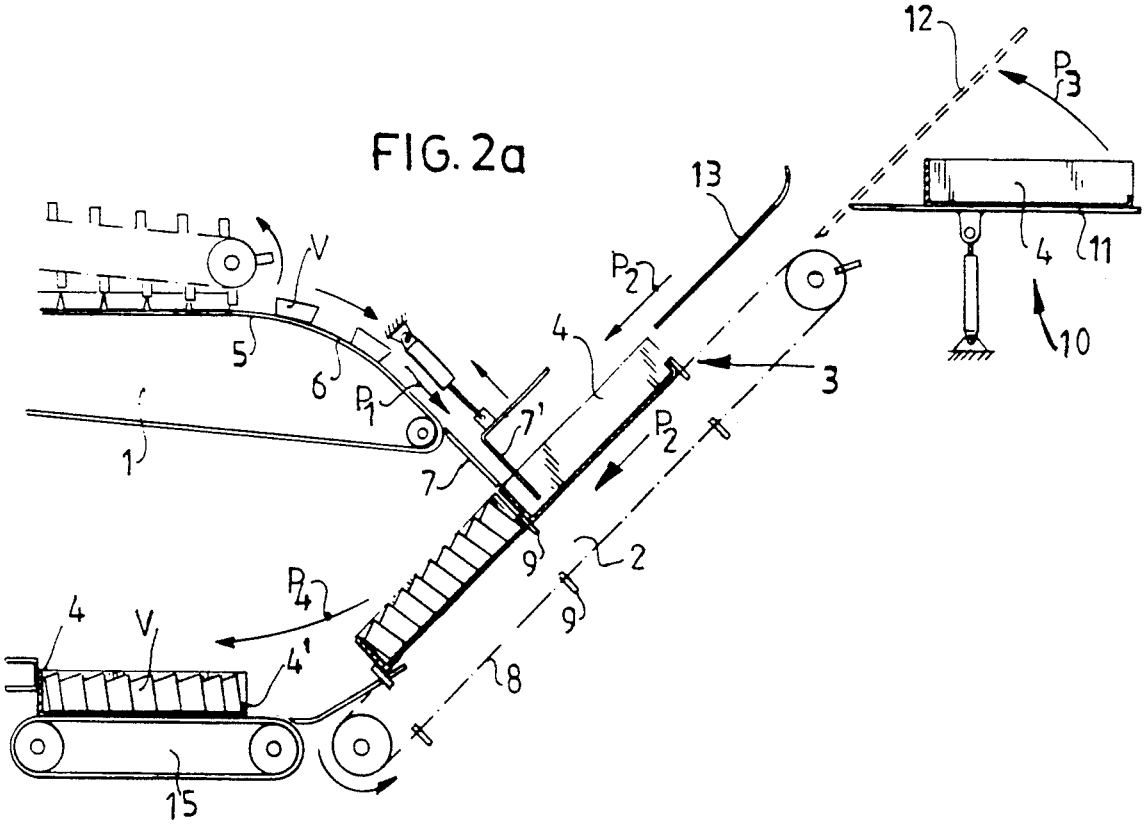
Figure 2B:
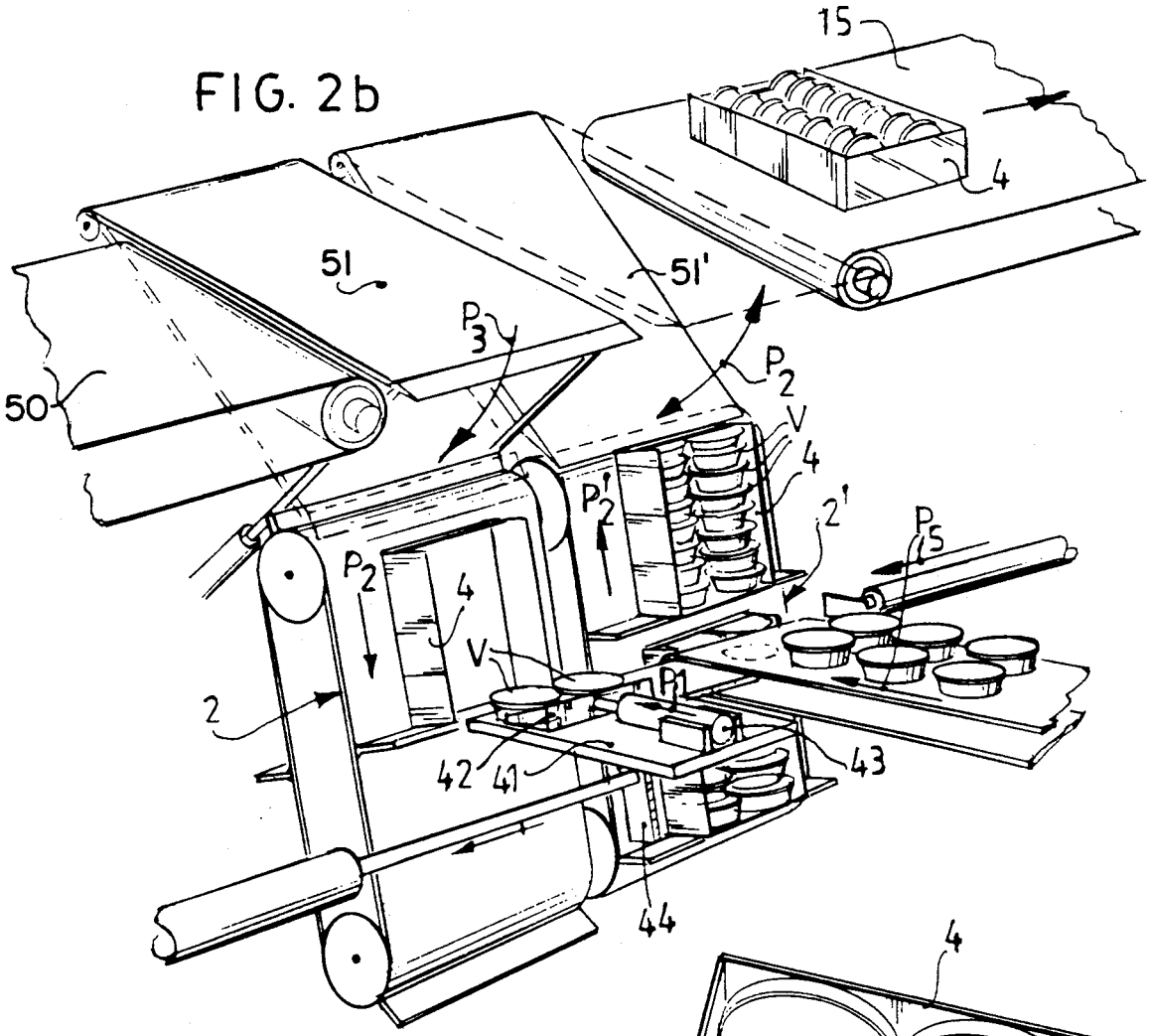
Figure 4:
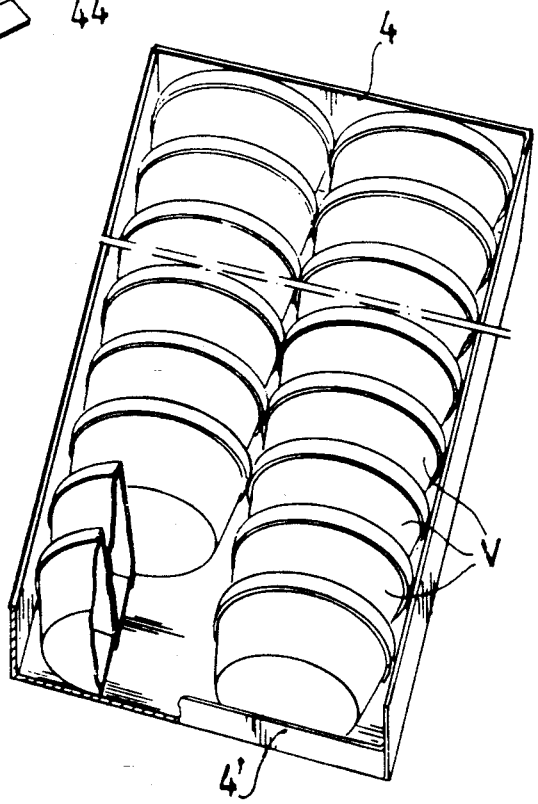
Figure 3:
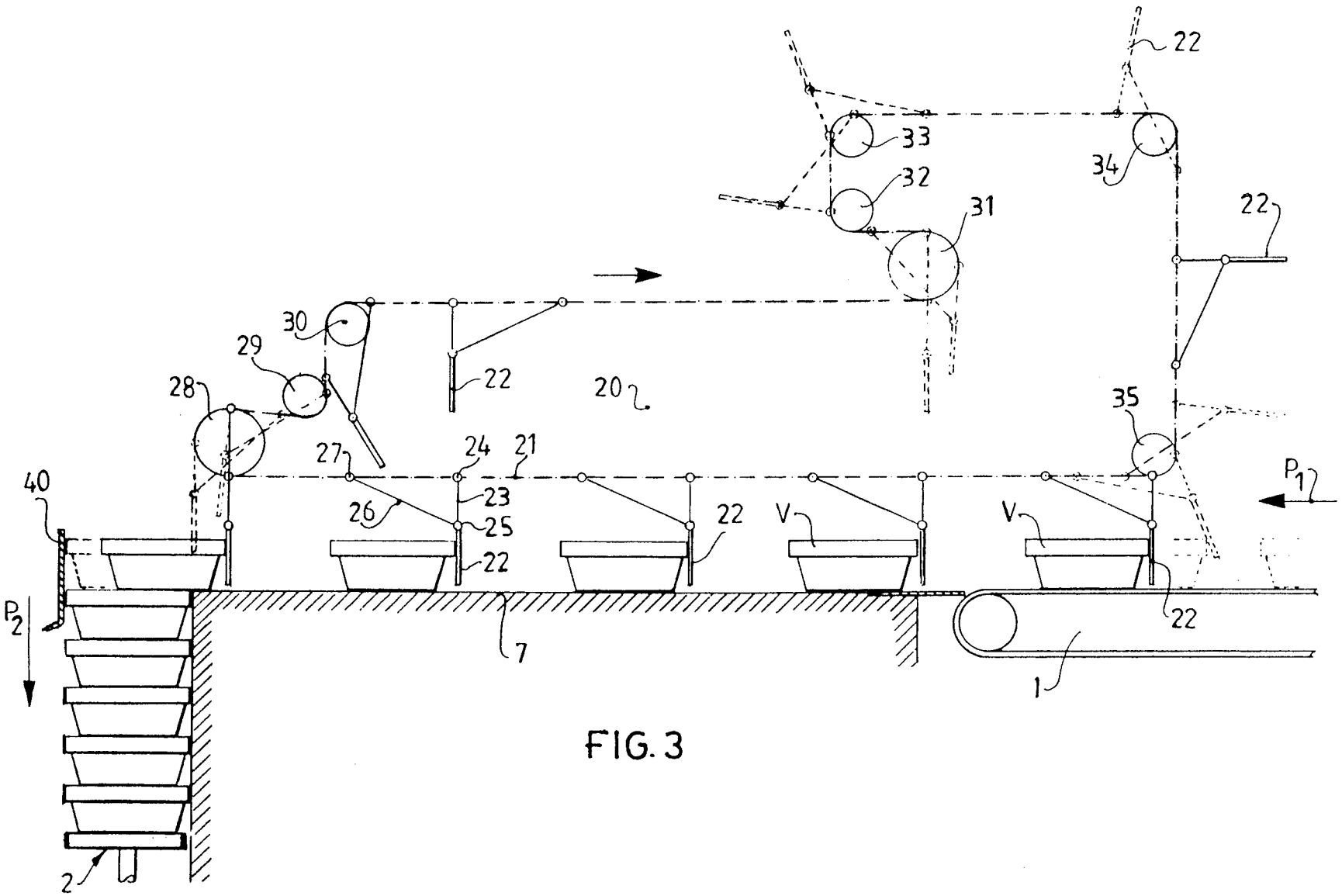

The invention will be further elucidated in the figure description given below of two embodiments. In the drawing:

FIG. 1 shows a schematic top view of a first embodiment of an apparatus operating according to the principles of the invention, FIG. *2a* is a schematic upright side view along the line II—II in FIG. 1, FIG. *2b* is a perspective top view of an alternative embodiment with respect to the apparatus in FIG. *2a*, FIG. 3 is an upright side view corresponding to FIG. 2 of a second embodiment of the apparatus according to the invention, FIG. 4 is a perspective top view of a box in the form of a display having therein articles arranged according to the invention.

The embodiment shown in FIGS. 1 and 2 consists of a first conveyor 1 for supplying the articles V for processing and a second conveyor 2 which supplies on its active portion 3 successive holders 4 into which the articles have to be arranged.

Placed on the conveyor 1 on its upper portion is a number of articles V, these being positioned in rows of four, for which purpose the first conveyor is provided with four endless belts 5. The upper portion of the endless belt is curved at 6 and runs such that the feed direction of the articles runs downward at a sloping angle, see arrow $P_1$. Arranged between the run-off edge of the first conveyor 1 and the second conveyor 2 are two guide plates 7, 7'. The plate 7' is retractable by means of a cylinder. The upper portion 3 of the second conveyor 2 likewise runs at an angle to the horizontal and in the embodiment shown the angle between the feed direction $P_1$ and the direction of forward movement $P_2$ of the upper part 3 of conveyor 2 is 90°.

The conveyor 2 is also embodied as endless belt 8 which is provided with strips 9, each for supporting a holder 4. The holder 4 comes from a collecting or folding station 10 formed with a tiltable platform 11 which can be tilted in the direction of arrow $P_3$ to a position indicated with the broken line 12 in FIG. 2. Under the influence of the force of gravity a holder 4 will strike against a strip 9, whereby the guiding by means of a guide strip 13 is assisted. As soon as a holder 4 lies against a strip 9, the strip 9 can be carried up to the guide plate 7, following which the filling of the articles into the holder can be carried out. To this end the conveyor 1 is set in motion in the direction of arrow $P_1$ and the articles each drop one by one into holder 4 under the influence of the force of gravity. Each time an article V has fallen into the holder this latter is moved downward in the direction of arrow $P_2$ over a distance at least equal to the height of article V. A holder 4 can thus be entirely filled with a row of articles V, see FIG. 2 bottom, after which the holder, when completely filled, can be carried away with the articles in the direction of arrow $P_4$ on a discharge conveyor 15. Before the filled holder is removed from the belt 8 a plate 7' is first retracted.

In the embodiment shown four endless belts 5 are arranged so that a holder 4 can be filled simultaneously with four mutually adjacent articles so that four rows of articles can be formed in a holder.

On the other hand it is possible to fill two holders placed next to one another with two rows of articles, which is shown in FIG. 1.

FIG. *2b* shows an alternative embodiment, wherein the same reference numerals are used for corresponding parts. The second conveyor 2 is more vertically positioned than in the embodiemt of FIG. *2a*, and therefor the feed of the articles V can be simplified by supporting them on a fixed table 41 and by using a pusher 42, driven by double actuated cilinder 43. Alongside the table a supply conveyor 44 is arranged, wherefrom the articles pair by pair are moved according to arrow P5 by suitable means (not shown) in front of the pusher.

Further the holder 4 is filled as explained above with respect to FIG. *2a*.

A filled holder 4 is thereupon moved sideways by means of a pusher 44 to a third conveyor 2' in construction similar to second conveyor 2, but driven in upward directions, so the filled holder 4 is brought back to the feed in level as given by conveyor 50 and tiltable platform 51. A second tiltable platform 51' will bring the filled holder from an upright position to a horizontal position, in order to be able to discharge it onto the discharge conveyor 15 at the same level as conveyor 50.

Shown in FIG. 3 is an embodiment whereby the same components are designated with the same reference numerals.

The first conveyor 1 extends here in horizontal direction so that the feed direction of the articles V indicated with the arrow $P_1$ also extends in horizontal manner.

The conveyor 2 for a support 40 operates in the direction of the arrow $P_2$, in this case vertically downward.

Arranged between the discharge edge of the first conveyor 1 and the second conveyor 2 is a carrying surface 7 which likewise extends horizontally. In order to achieve the transport of the articles V over the carrying surface 7 in an accurate manner and at a mutual interval a transporting system 20 is arranged above the surface 7'.

The transporting system 20 consists of an endless chain 21 which is trained around diverse turning rollers and on which carrier members 22 are arranged at regular intervals. Each carrier member 22 is a pressure strip provided with an arm 23 which is connected for pivoting at 24 with the chain 21. Arranged between a pivot point 25 of the arm 23 and the chain 21 is a pull rod 26 which is pivotably connected at 27 to chain 21. The function of the pull rod 26 is such that at the turning rollers, for instance 28, 29 and 30, arranged at appropriate positions, the pressure member 22, which extends vertically downward above the surface 7, initially moves vertically upward at the turning roller 28, as a result of which it is removed from the surface 7. After the turning rollers 29, 30 the pressure member 22 again points downward in the segment towards the following turning roller 31, after which in the subsequent turning rollers 32, 33, 34 the pressure member 22 points initially upward and then to the right in FIG. 3. When carrying along an article V from the end of conveyor 1 the pressure member 22 will place itself at turning roller 35 behind an article V and carry it along and push it forward over the surface 7 and the support 40 arranged on conveyor 2. Each time an article is placed in support 40, this latter will drop downward over a distance at least equal to the height of the article in order to accommodate the following article. As soon as the support 60 is completely filled, the stack of articles out for futher processing, whereupon the conveyor has to be reset in the start position whereby the plateau 2 is located at the height of the surface 7 for the next cycle.

It will be apparent that in this embodiment also more than one row of articles can be supplied so that the support 40 can simultaneously accommodate articles arranged in multiple rows.

A final result can be seen in FIG. 4 whereby the holder 4 takes the form of a folded cardboard box, of which the front wall 4' is lower than the other side walls thereof. The low front wall 4' gives the user a full view of the promotion material placed here on the side of the packaging of small diameter.

A reverse arrangement of the articles V is of course also possible, this as shown in the FIGS. 2 and 3.

The articles displayed can be of random type and shape, for instance cone-shaped tubs for packaging butter, margarine and other spreadable substances.

The invention is not limited to the above described embodiments.

I claim:

1. A method for continuous arrangement of rows of articles in a container, said container having a bottom surface, a first side edge extending from said bottom surface and an open upper end opposed to said bottom surface, said method comprising:

(a) feeding said container along a substantially horizontal upper plane, wherein said bottom surface of said container lies in said upper plane;

(b) transferring said container downwardly from said upper plane and into a nonhorizontal position such that said bottom surface of said container lies in a nonhorizontal plane and said first side edge of said container is positioned downwardly;

(c) stacking a first row of said articles in said container upon said first side edge, said first row containing a predetermined number of said articles;

(d) moving said container downwardly along said nonhorizontal plane a sufficient distance to permit stacking an additional row of said articles upon a previously stacked row of said articles, and stacking said additional row of said articles upon said previously stacked row of articles, until said container includes a predetermined number of rows of said articles;

(e) transferring said container upwardly along said nonhorizontal plane and returning said container to said upper plane such that said bottom surface of said container lies in said upper plane; and (f) removing said container along said upper plane.

2. The method according to claim 1, additionally including moving said container horizontally after said container contains a predetermined number of rows and prior to transferring said container upwardly along said nonhorizontal plane.

3. The method according to claim 1, additionally including horizontally conveying said articles to said container.

4. The method according to claim 1, wherein said articles are individually conveyed to said container.

5. The method according to claim 1, wherein prearranged rows of said articles, each containing a plurality of said articles, are conveyed to said container.

6. The method according to claim 5, additionally including feeding said prearranged rows of said articles along a first horizontal direction, conveying each of said prearranged rows of articles along a second horizontal direction perpendicular to said first horizontal direction, and delivering each of said prearranged rows of said articles to said container along a third horizontal direction parallel to said first horizontal direction.

7. The method according to claim 1, wherein said nonhorizontal plane is inclined.

8. The method according to claim 1, wherein said nonhorizontal plane is vertical.

9. The method according to claim 1, wherein said rows of articles contains a plurality of articles.

10. An apparatus for continuous arrangement of rows of articles in a container, said container having a bottom surface, a first side edge extending from said bottom surface and an open upper end opposed to said bottom surface, said apparatus comprising:

(a) container feeding means for feeding said container along a substantially horizontal upper plane such that said bottom surface of said container lies in said upper plane;

(b) first transfer means for transferring said container from said upper plane of said container feeding means into a nonhorizontal position;

(c) a downward container conveyor positioned below said first transfer means, said downward container conveyor for moving said container incrementally downward along a nonhorizontal plane after said container has been filled with one of said rows of articles;

(d) article feeding means for feeding said articles to said container positioned on said downward container conveyor;

(e) an upward container conveyor parallel to said downward container conveyor, said upward container conveyor for moving said container upwardly along said nonhorizontal plane after said container includes a predetermined number of rows of articles;

(f) second transfer means for transferring said container from a nonhorizontal position and to return said container to said upper plane; and (g) container discharge means for conveying said container from said second transfer means along said upper plane.

11. The apparatus according to claim 10, wherein said first and second transfer means comprises a plate tiltable between said upper plane and a nonhorizontal plane.

12. The apparatus according to claim 10, additionally including means for moving said container horizontally between said downward container conveyor and said upward container conveyor.

13. The apparatus according to claim 10, wherein said article feeding means includes means for delivering said articles to said container along a horizontal feed direction.

14. The apparatus according to claim 13, wherein said means for delivering comprises a pusher for pushing said articles from a planar surface into said container.

15. The apparatus according to claim 10, wherein said articles feeding means comprises an article feed conveyor for feeding articles along a first horizontal direction, means for deliverying said articles to said container along a second horizontal direction parallel to said first horizontal direction, and means for transferring articles between said article feed conveyor and said means for delivering.

16. The apparatus according to claim 10, wherein said nonhorizontal plane is inclined.

17. The apparatus according to claim 10, wherein said nonhorizontal plane is vertical.

* * * * *